US005725726A

United States Patent [19]

Yu

[11] Patent Number: 5,725,726

[45] Date of Patent: Mar. 10, 1998

[54] TAPE DISPENSER WITH A CONTACT ROLLER

[75] Inventor: Ta-Cheng Yu, Taichung Hsien, Taiwan

[73] Assignee: Yang Bey Industrial Co., Ltd., Taichung Hsien, Taiwan

[21] Appl. No.: 738,810

[22] Filed: Oct. 28, 1996

[51] Int. Cl.[6] ..... B32B 31/00

[52] U.S. Cl. ..... 156/577; 156/579; 242/588.2

[58] Field of Search ..... 156/523, 527, 156/574, 577, 579; 242/588, 588.2

[56] References Cited

U.S. PATENT DOCUMENTS

| | | | |
|---|---|---|---|
| 3,972,769 | 8/1976 | Lissoni | 156/579 X |
| 5,164,038 | 11/1992 | Sundqvist | 156/577 |
| 5,549,255 | 8/1996 | Huang | 156/579 X |

FOREIGN PATENT DOCUMENTS

| | | | |
|---|---|---|---|
| 2053139 | 2/1981 | United Kingdom | 156/540 |
| WO 90/00968 | 2/1989 | WIPO | 242/422.5 |

*Primary Examiner*—Mark A. Osele

*Attorney, Agent, or Firm*—Limbach & Limbach L.L.P.

[57] ABSTRACT

A tape dispenser includes a support, a tape-mounting member which is mounted rotatably on the support to hold a tape reel thereon, and a positioning roller which is mounted on the support and which is spaced apart from the tape-mounting member for holding the stripped portion of the tape on the tape reel. A contact roller is mounted movably on the support adjacent to the tape-mounting member for rotation about an axis parallel to that of the tape-mounting member. The contact roller is adjustable in distance from the tape-mounting member so as to contact constantly the surface of the unstripped portion of the tape on the tape reel, and to permit the stripped portion to be transferred from the unstripped portion to the contact roller as soon as the stripped portion leaves the unstripped portion.

3 Claims, 9 Drawing Sheets

TAPE DISPENSER WITH A CONTACT ROLLER

BACKGROUND OF THE INVENTION

1. Field of the Invention

This invention relates to a tape dispenser, more particularly to a tape dispenser having a contact roller for reducing the noise generated upon stripping the tape.

2. Description of the Related Art

A tape dispenser generally comprises a tape storage station and a tape dispensing port which is spaced from the tape storage station. Referring to FIG. 1 and 2, a conventional portable tape dispenser 10 is shown to comprise a frame 11 which has a positioning plate 111 of L-shaped cross-section that includes a side plate 112 and a base plate 113. The frame 11 has a tape storage station with a rotatable tape-mounting member 115 for mounting a paper core 21 of a packing tape 20, and a tape dispensing port 12. A positioning roller 121 is mounted at the tape dispensing port 12. A static adhesion plate 122 is provided above the positioning roller 121. A cutter seat 13 is mounted above the port 12 adjacent to the positioning roller 121. The cutter seat 13 includes a cutter 131 and a smoothing plate 132 which are positioned above the adhesion plate 122. A handle 114 is fixed to the lower side face of the base plate 113 and is disposed in a generally perpendicular position.

In use, the distal end portion of the tape 20 is pulled out from the tape dispensing port 12 and is trained over the positioning roller 121. When the distal end of the tape 20 is pressed against a desired surface by the positioning roller 121, it is adhered to the desired surface. The adhered portion of the tape 20 can be cut off by pressing the cutter 131 against the tape 20. The static adhesion plate 132 serves to attract the distal end of the unused portion of the tape 20 thereon. Since the tape dispenser of this type facilitates the stripping of the tape and the adhering of the same to a surface, it can speed up a packing operation in production lines. However, there is a disadvantage in that the production lines produce unpleasant noise during the stripping of tapes. This is because the spot 23 where the stripped part of the tape 20 first contacts the positioning roller 121 is remote from the unstripped point 22 of the tape 20 so that, when stripping the tape 20, the tape portion which extends between the point 22 and the spot 23 vibrates with considerably high frequency. The noise increases when the thickness of the tape reel decreases and the distance increases. Therefore, elimination of the noise problem is desirable.

SUMMARY OF THE INVENTION

Therefore, the objective of the present invention is to provide a tape dispenser with means for buffering the noise generated upon stripping tape.

According to this invention, the tape dispenser includes a support, a tape-mounting member which is mounted rotatably on the support to hold a tape reel thereon, and a positioning roller which is mounted on the support and which is spaced apart from the tape-mounting member for holding a stripped portion of tape on the tape reel. A contact roller is mounted movably on the support adjacent to the tape-mounting member for rotation about an axis parallel to that of the tape-mounting member. The contact roller is adjustable in distance from the tape-mounting member so as to contact constantly the surface of the unstripped portion of the tape reel, and to permit the stripped portion to be transferred from the unstripped portion to the contact roller as soon as the stripped portion leaves the unstripped portion.

BRIEF DESCRIPTION OF THIS DRAWINGS

Other features and advantages of the present invention will become apparent in the following detailed description of preferred embodiments of the invention, with reference to the accompanying drawings, in which.

DETAILED DESCRIPTION OF THE PREFERRED EMBODIMENTS

Before the present invention is described in greater detail, it should be noted that like elements are denoted by the same reference numbers throughout the disclosure.

Figure 1:
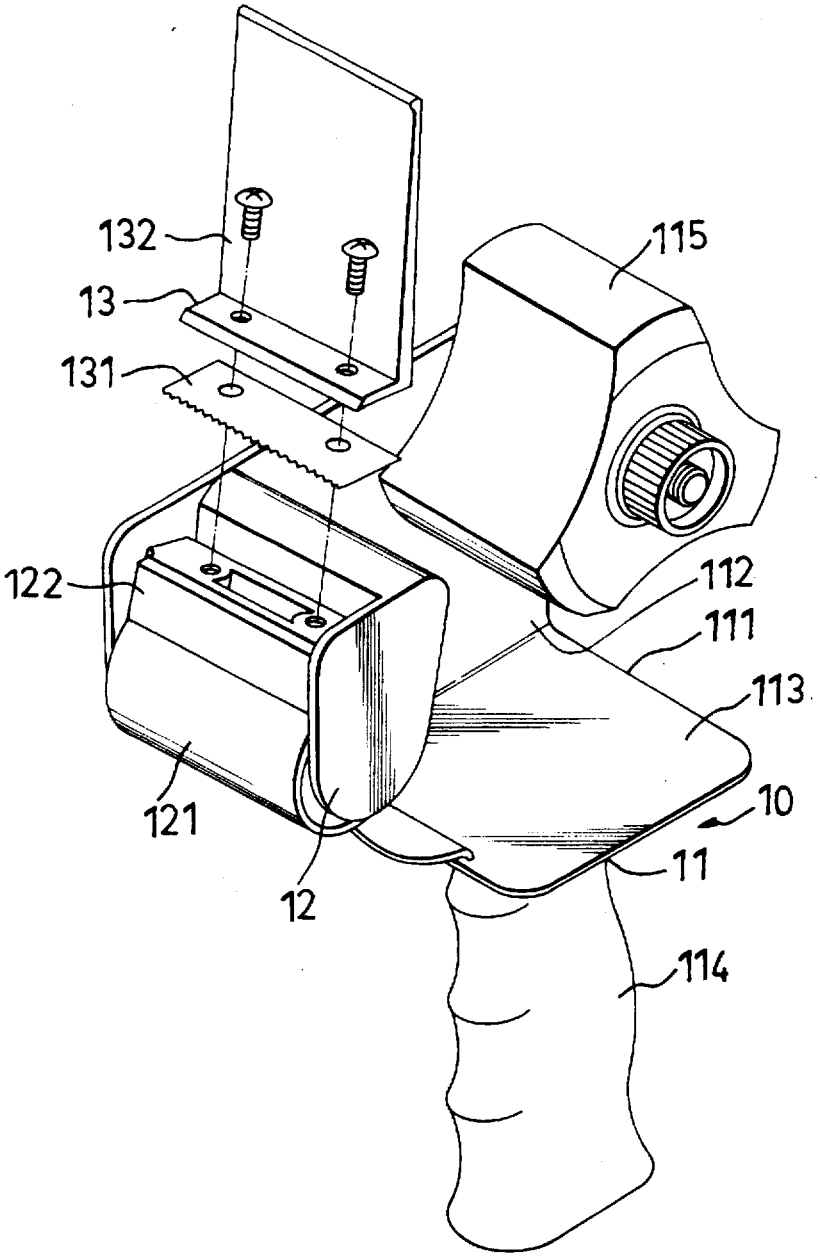
FIG.1 PRIOR ART
FIGS. 1 and 2 show a conventional tape dispenser.
Figure 2:
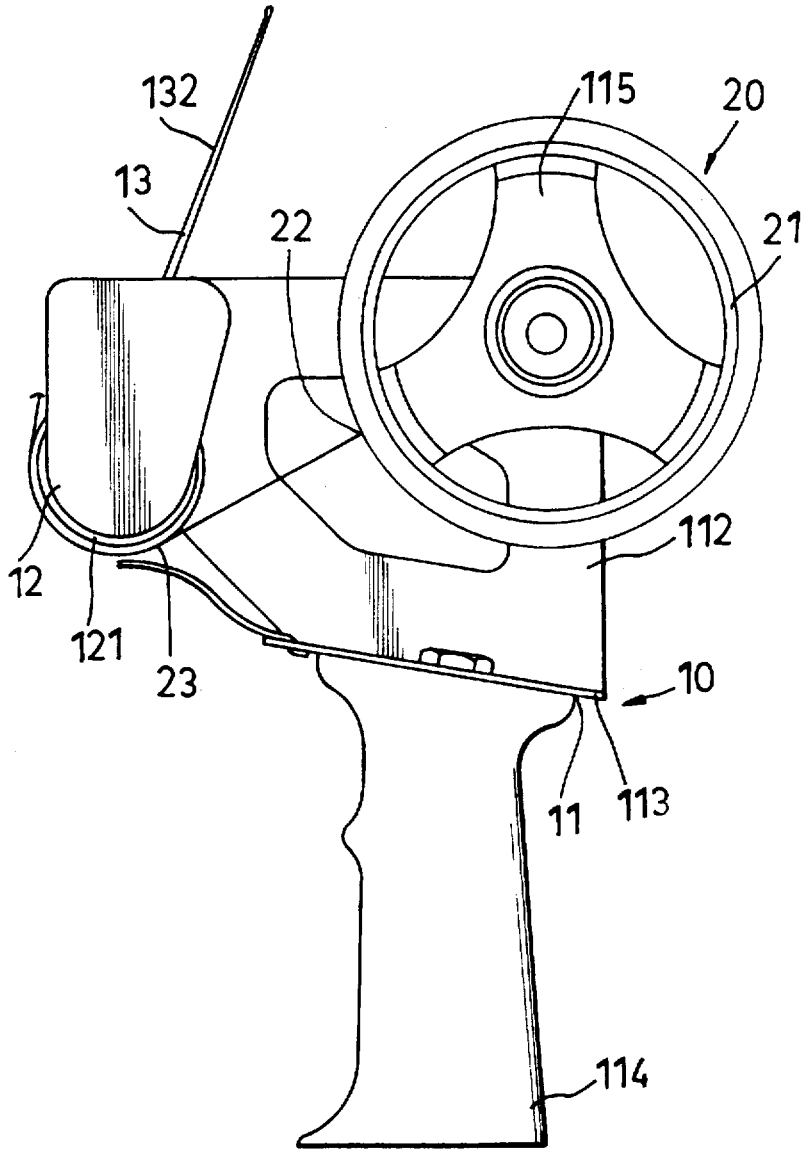
FIG.2 PRIOR ART
Figure 3:
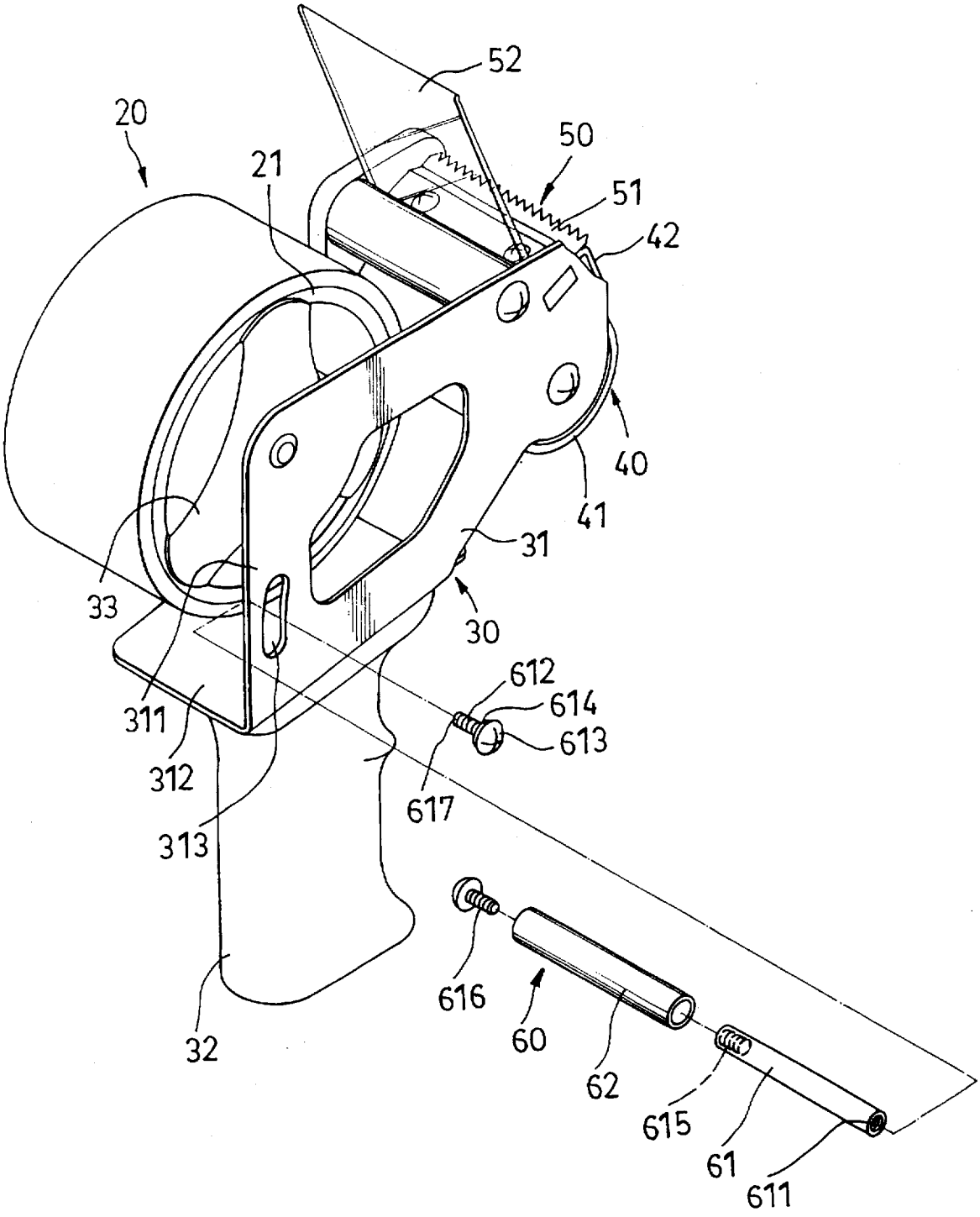
FIG. 3 is an exploded view of a first preferred embodiment of the tape dispenser according the present invention.
Figure 4:
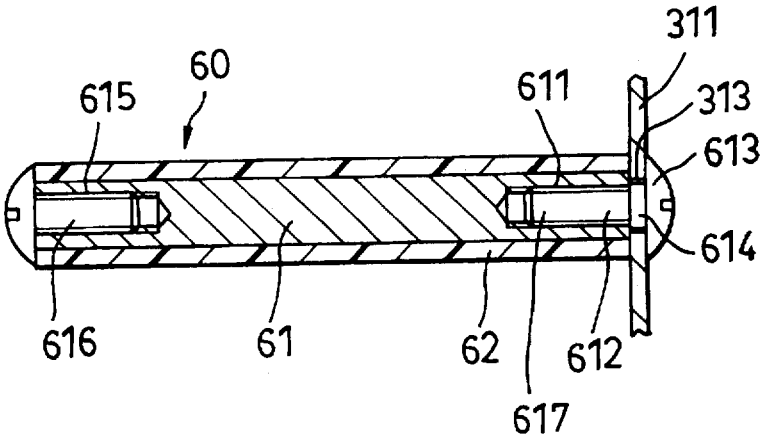
FIG. 4 is a sectional view of a contact roller employed in the tape dispenser shown in FIG. 3.

Referring to FIGS. 3 and 4, a first preferred embodiment of the present invention is shown to comprise a frame 30 with a support plate 31 which has an L-shaped cross-section and which is formed by a base plate 312 and a side plate 311. A handle 32 is fixed to the lower side face of the base plate 312 and extends downwardly therefrom. A tape storage station has a tape-mounting member 33 which is mounted rotatably on the front part of the side plate 311 above the base plate 312 for mounting a tape reel 20 thereon. A tape dispensing station 40 has a tape positioning roller 41 which is fixed on the rear part of the side plate 311. A static adhesion plate 42 and a cutter device 50 are mounted above the positioning roller 41. The cutter device 50 includes a cutter edge 51 and incorporates a smoothing plate 52. A contact roller 60 is mounted adjacent to the tape-mounting member 33 for rotation about an axis which is parallel to that of the positioning roller 41. An elongated hole 313 is provided on the side plate 311 near the tape-mounting member 33.

The contact roller 60 is mounted rotatably on the side plate 311 below the tape-mounting member 33 and includes a shaft 61 and a rotatable sleeve 62. With reference to FIG. 4, the shaft 61 has a threaded first end portion 611 and a threaded second end portion 615. A threaded bolt 612 has a head 613 with a diameter greater than the width of the elongated hole 313 for abutting against on outer side of the side plate 311, a sliding portion 614 extending from the head 613 for sliding into the hole 313, and a threaded portion 617 engaging the threaded first end portion 611 so as to secure the shaft 61 onto the side plate 311. The sleeve 62 is sleeved rotatably on the shaft 61. A screw 616 is threaded into the second end portion 615 to prevent the sleeve 62 from separating from the shaft 61. The sliding portion 614 is movable along the elongated hole 313 so that the distance of the contact roller 60 is radially adjustable with respect to the tape reel 20. As such, the contact roller 60 can contact constantly the surface of the tape reel 20 regardless of the varying thickness of the tape reel 20 resulting from the unreeling operation.

Figure 5:
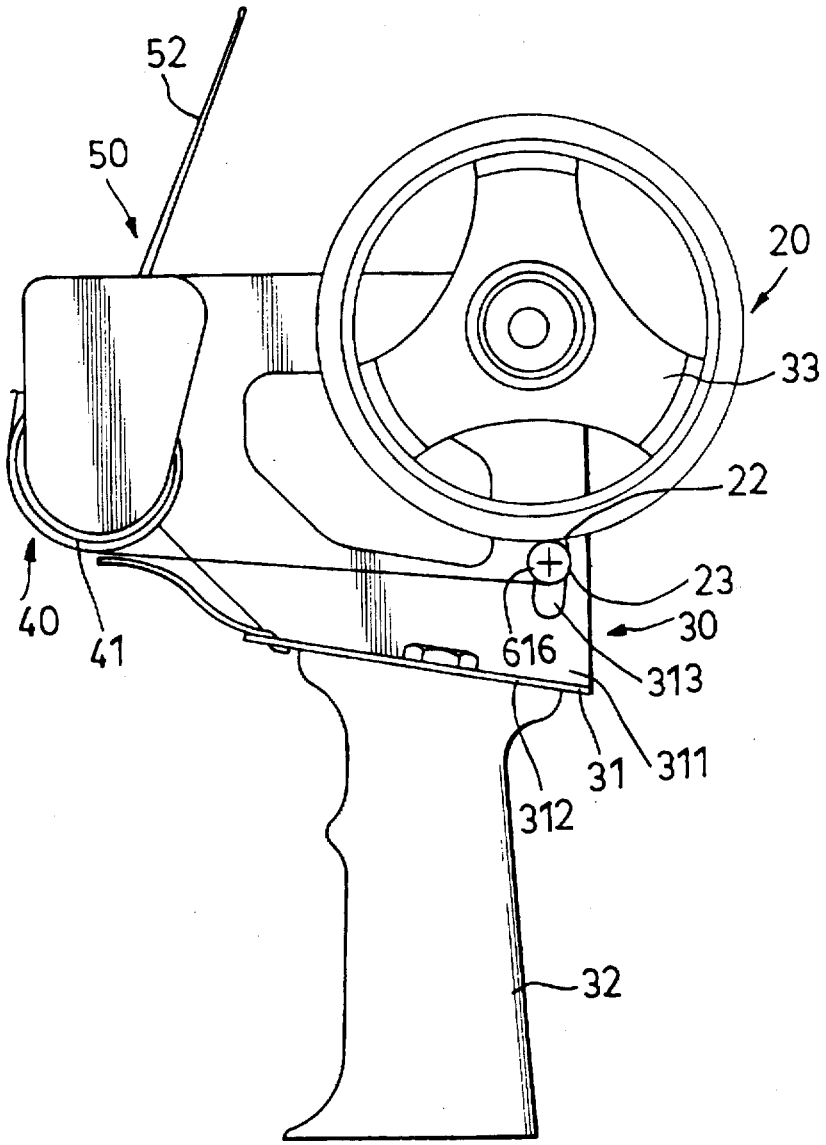
FIG. 5 is a side elevation view of the first embodiment.

In use, referring to FIG. 5, the distal end of the stripped portion of the tape reel 20 is pulled out and is trained over the positioning roller 41 after passing over the contact roller 60. The distal end of the tape reel 20 is then adhered to the static adhesion plate 42. The contact roller 60 is kept in contact with the tape reel 20 by the tension of the stripped portion of the tape reel 20. Since the stripped portion is transferred to and is supported by the contact roller 60 as soon as it leaves the unstripped portion of the tape reel 20, the frequency of the vibration of the stripped tape portion is damped early and the noise that is generated upon stripping of the tape is reduced. In addition, the sleeve 62 is made of a vibration absorbent plastic material so as to reduce vibration.

Figure 6:
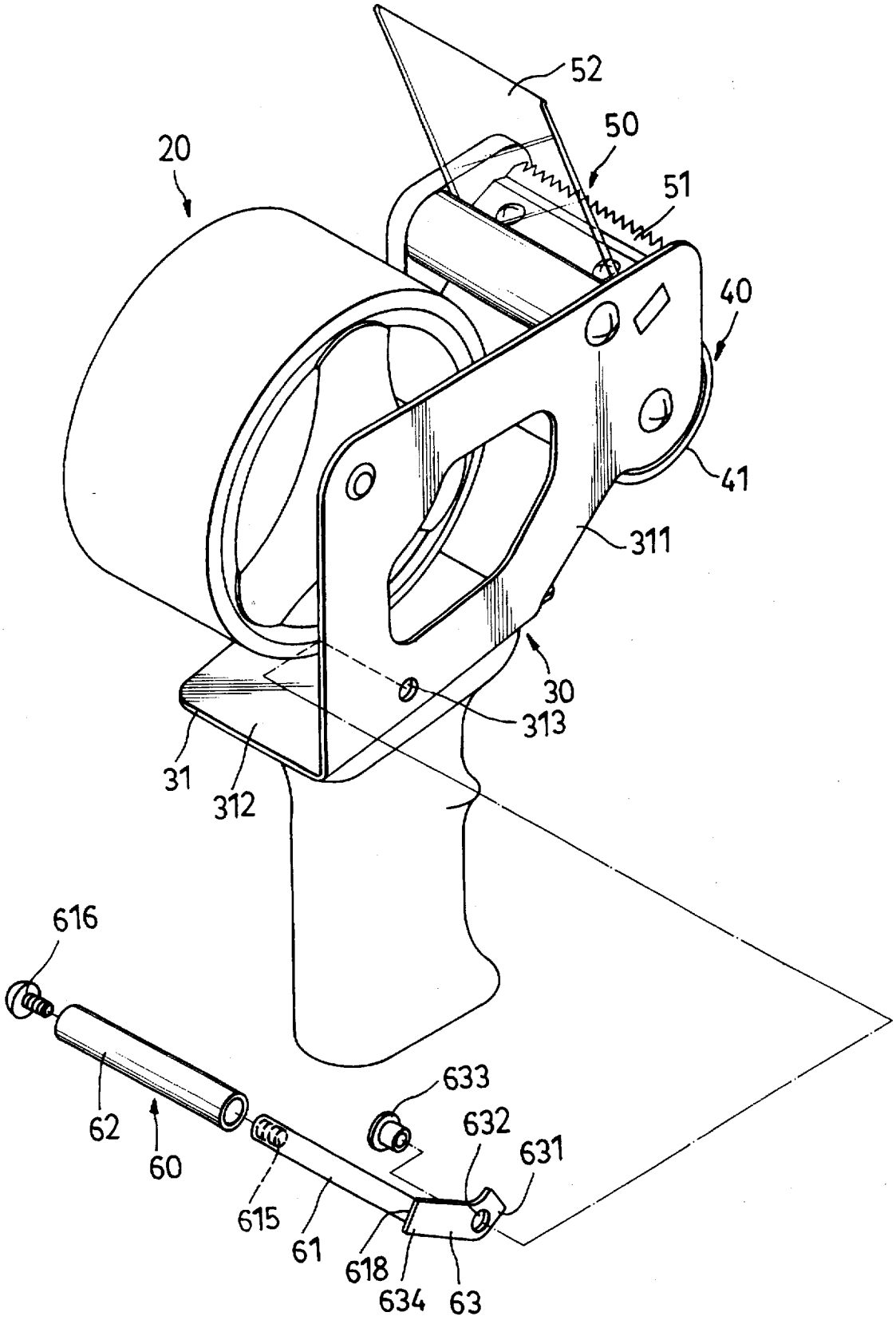
FIG. 6 is an exploded view of a second preferred embodiment according to the present invention.
Figure 7:
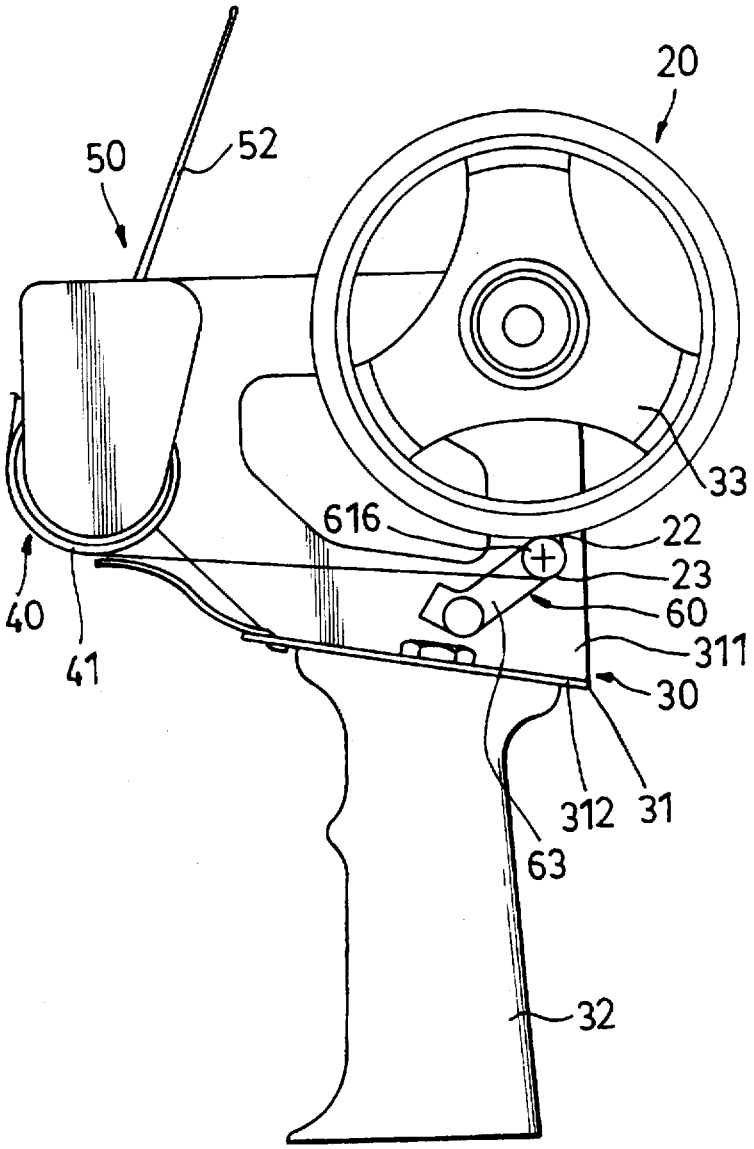
FIG. 7 is a side elevation view of the second embodiment.

FIGS. 6 and 7 show a second embodiment of the present invention. The contact roller 60 includes a shaft 61 which has a first end portion 618 and a threaded second end portion 615, and a rotatable sleeve 62 which is sleeved on the shaft 61. A crank 63 has one end 631 which is pivoted to the side plate 311 in such a manner that a pivot pin 633 is inserted into a hole 313 in the side plate 311 and a pivot hole 632 in the end 631. The other end 634 of the crank 63 is fixed to the first end portion 618 of the shaft 61. A screw 616 is inserted into the second end portion 615 of the shaft 61, thereby mounting rotatably the sleeve 62 on the shaft 61. The crank 63 is turnable about the pivot pin 633 in a plane parallel to the side plate 311. The distance of the contact roller 60 from the tape reel 20 is adjusted via the crank 63 which is turned by the tension of the unreeled tape.

Figure 8:
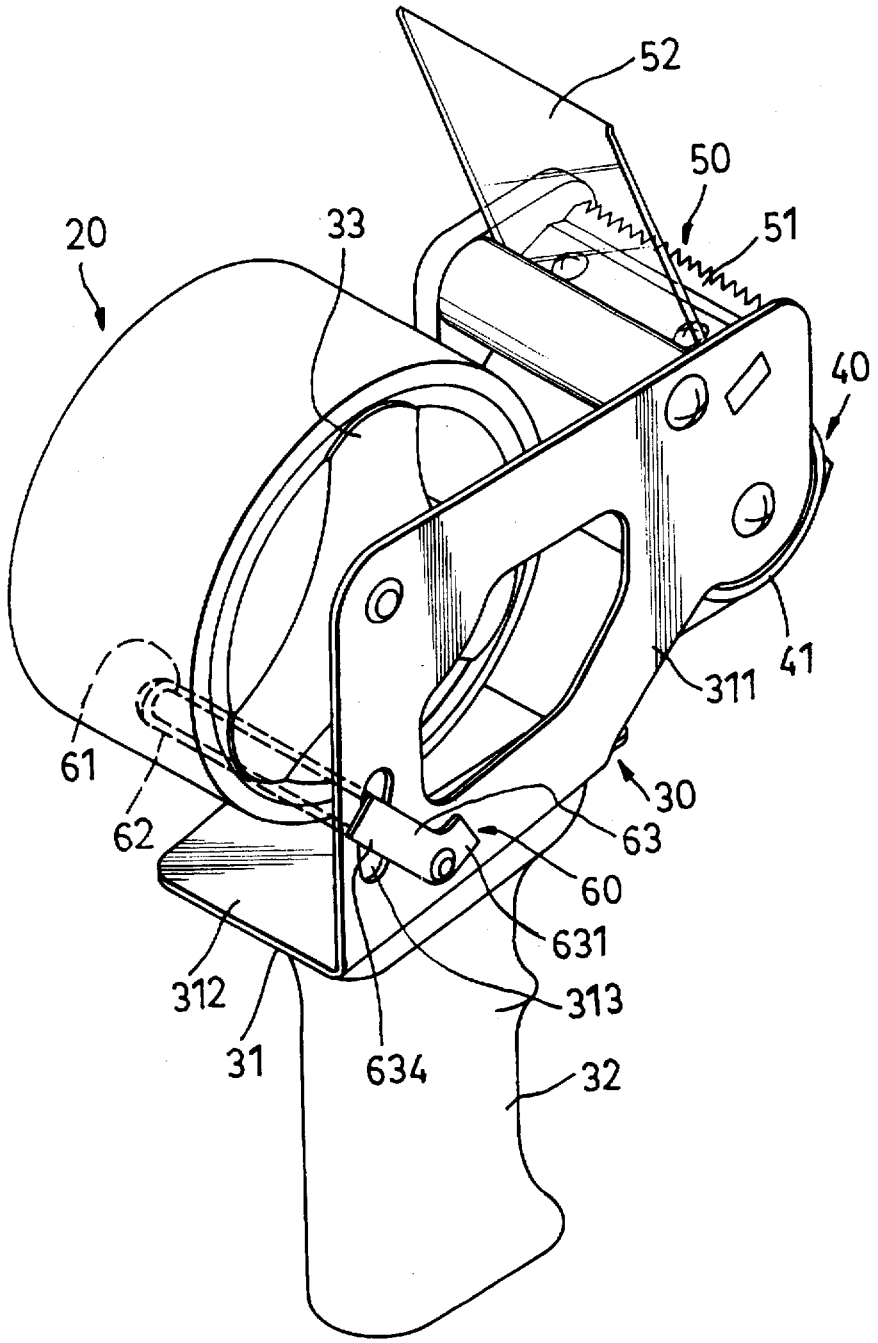
FIG. 8 is a perspective view of a third preferred embodiment according to the present invention.
Figure 9:
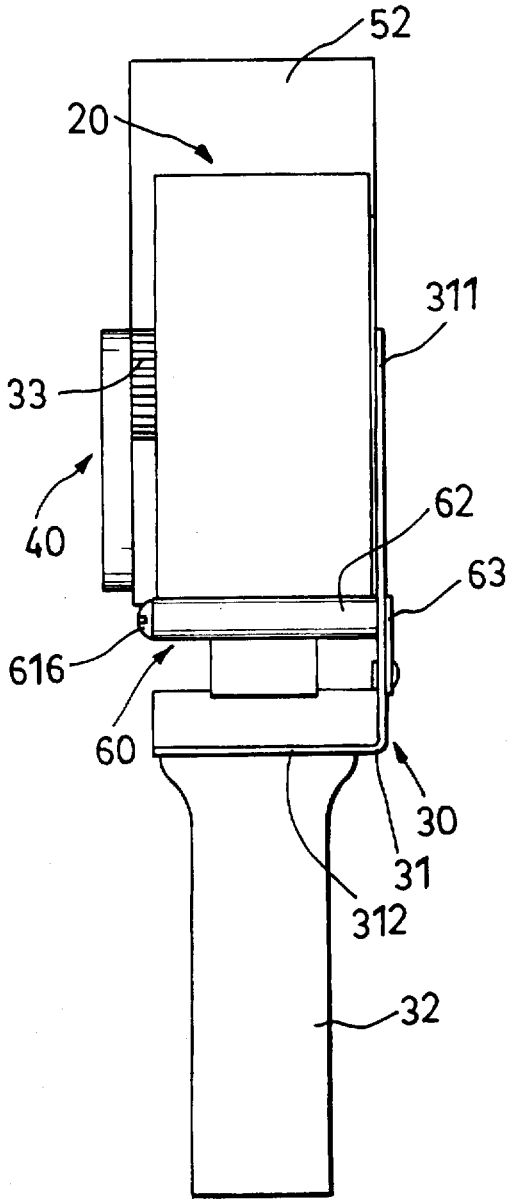
FIG. 9 is a front elevation view of the third embodiment.

Referring to FIGS. 8 and 9, a third embodiment of the present invention is shown. The side plate 311 has an elongated hole 313. The contact roller 60 includes a shaft 61 which has one end fixed to a second end 634 of a crank 63, and a rotatable sleeve 62 which is sleeved on the shaft 61. The first end 631 of the crank 63 is mounted pivotally on the side plate 311. The shaft 61 passes through the elongated hole 313. When the tape 20 is unreeled, the contact roller 60 can move along the elongated hole 313 and cause the crank 63 to turn. The crank 63 serves as a movable support for the contact roller 60.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A tape dispenser, comprising:

a support;

a tape-mounting member mounted rotatably on said support to hold a tape reel thereon;

a positioning roller mounted on said support and spaced apart from said tape-mounting member for holding a stripped portion of a tape which is unreeled from the tape reel; and a contact roller mounted movably on said support adjacent to said tape-mounting member for rotation about an axis parallel to that of said tape-mounting member, said contact roller being adjustable in distance from said tape-mounting member so as to constantly contact a surface of an unstripped portion of the tape on the tape reel and to permit the stripped portion of the tape to be transferred from said unstripped portion to said contact roller as soon as the stripped portion leaves the unstripped portion;

wherein said contact roller includes a shaft which is mounted movably on said support, and a rotatable sleeve provided around said shaft to contact the tape reel; and wherein said support has a base plate and a side plate which extends upwardly from one side of said base plate, all of said tape mounting member, said positioning roller, and said contact roller being mounted on and substantially perpendicular to said side plate above said base plate; and further wherein said side plate has an elongated hole, said shaft having one end attached to said side plate in said elongated hole for sliding along said elongated hole.

2. A tape dispenser, comprising:

a support;

a tape-mounting member mounted rotatably on said support to hold a tape reel thereon;

a positioning roller mounted on said support and spaced apart from said tape-mounting member for holding a stripped portion of a tape which is unreeled from the tape reel; and a contact roller mounted movably on said support adjacent to said tape-mounting member for rotation about an axis parallel to that of said tape-mounting member, said contact roller being adjustable in distance from said tape-mounting member so as to constantly contact a surface of an unstripped portion of the tape on the tape reel and to permit the stripped portion of the tape to be transferred from said unstripped portion to said contact roller as soon as the stripped portion leaves the unstripped portion;

wherein said contact roller includes a shaft which is mounted movably on said support, and a rotatable sleeve provided around said shaft to contact the tape reel; and wherein said support has a base plate and a side plate which extends upwardly from one side of said base plate, all of said tape mounting member, said positioning roller, and said contact roller being mounted on and substantially perpendicular to said side plate above said base plate; and further wherein said contact roller further has a crank member which is pivoted and turnable in a plane substantially parallel to said side plate, said shaft having one end connected to said crank member and being right-angled with respect to said crank member.

3. A tape dispenser as claimed in claim 2, wherein said side plate has an elongated hole, said shaft having one end passing through said elongated hole for connection with said crank member.

* * * * *